US005419130A

United States Patent [19]

Ruckgauer et al.

[11] Patent Number: 5,419,130

[45] Date of Patent: May 30, 1995

[54] HYDROSTATIC MACHINE WITH DRAIN OIL DISCHARGE

[75] Inventors: Norbert Ruckgauer, Huttisheim; Werner Hormann, Illertissen, both of Germany

[73] Assignee: Hydromatik GmbH, Elchingen, Germany

[21] Appl. No.: 181,596

[22] Filed: Jan. 13, 1994

Related U.S. Application Data

[63] Continuation-in-part of Ser. No. 912,869, Sep. 13, 1992, abandoned.

[30] Foreign Application Priority Data

Aug. 28, 1991 [DE] Germany ..... 41 28 615.4

[51] Int. Cl.[6] ..... F16D 31/02; F16D 39/00

[52] U.S. Cl. ..... 60/456; 60/488; 184/1.5

[58] Field of Search ..... 60/456, 487, 488, 455; 184/1.5, 6.2, 103.1

[56] References Cited

U.S. PATENT DOCUMENTS

| | | | |
|---|---|---|---|
| 2,438,245 | 3/1948 | Gregg . | |
| 3,058,297 | 10/1962 | Tolley . | |
| 3,291,067 | 12/1966 | North . | |
| 3,680,312 | 8/1972 | Forster . | |
| 3,750,406 | 8/1973 | Verlinde et al. | 60/488 X |
| 3,886,742 | 6/1975 | Johnson | 60/488 |
| 4,864,823 | 9/1989 | Ikejiri et al. | 60/488 |

FOREIGN PATENT DOCUMENTS

| | | |
|---|---|---|
| 677735 | 7/1939 | Germany . |
| 2909878 | 9/1980 | Germany . |
| 2931641 | 2/1981 | Germany . |
| 2638890 | 2/1988 | Germany . |

*Primary Examiner*—Edward K. Look
*Assistant Examiner*—Hoang Nguyen
*Attorney, Agent, or Firm*—Scully, Scott, Murphy & Presser

[57] ABSTRACT

A hydrostatic machine which includes a housing having an internal space accommodating a rotatably journaled driving mechanism, and wherein the portion of the internal space which is not occupied by the driving mechanism encompasses a drain oil chamber which receives the drain oil inclusive of lubricating oil which is discharged from bearing locations of the hydrostatic machine, and which is connected or port to a tank through at least one drain oil connection of the housing and through a drain oil line. A pump is arranged in the drain oil line which is in a driving or operative connection with the hydrostatic machine, and which pumps off drain oil from the drain oil chamber during the operation of the hydrostatic machine, and possesses an output delivery correlated in such a manner therewith that the drain oil remaining in the drain oil chamber assumes that particular specified level in the lower region of the drain oil chamber, at which at least no splashing losses are encountered due to the rotation of the driving mechanism in the drain oil which exceed the mechanical losses of the hydrostatic machine.

19 Claims, 3 Drawing Sheets

HYDROSTATIC MACHINE WITH DRAIN OIL DISCHARGE

CROSS-REFERENCE TO RELATED APPLICATIONS

This application is a continuation-in-part application of Ser. No. 07/912,869; filed on Jul. 13, 1992, now abandoned.

BACKGROUND OF THE INVENTION

1. Field of the Invention

The present invention relates to a hydrostatic machine which includes a housing having an internal space accommodating a rotatably journaled driving mechanism, and wherein the portion of the internal space which is not occupied by the driving mechanism encompasses a drain oil chamber which receives the drain oil inclusive of lubricating oil which is discharged from bearing locations of the hydrostatic machine, and which is connected or port to a tank through at least one drain oil connection of the housing and through a drain oil line.

2. Discussion of the Prior Art

Hydrostatic machines of this type operate in accordance with the kind of construction thereof, at an overall degree of efficiency which lies within the range of about 75% to about 93%, and which is equal to the product obtained from the volumetric efficiency and from the hydraulic-mechanical efficiency.

The volumetric efficiency encompasses the drain oil losses which are encountered from the flows of drain oil produced and discharged from the internal oil circulation between the high-pressure and low-pressure sides of the hydrostatic machine, especially from the high pressure side thereof, and which collect in the drain oil chamber, and wherein these increase with an increasing speed in the rotation of the driving mechanism and a rising pressure differential between the high-pressure side and the drain oil chamber. As is known; for example, from the disclosure of U.S. Pat. No. 4,515,067, portions of these flows of drain oil are employed for the supplying of lubricating oil to the hydrostatic machine, in that they are conducted through the hydrostatic and/or mechanical bearing locations thereof before passing into the drain oil chamber.

The hydraulic-mechanical degree of efficiency is obtained from the hydraulic and from the mechanical losses. The hydraulic losses increase with an increasing speed of rotation of the driving mechanism, and incorporate a loss constituent which is dependent upon the density of the pressure medium, and a viscous loss constituent which is dependent upon the dynamic viscosity of the pressure medium. The mechanical losses are obtained from the increasing piston friction and bearing friction of the hydrostatic machine which emanate from the rising pressure differential.

Inasmuch as the overall degree of efficiency, as already mentioned hereinabove, is the product from the volumetric and hydraulic-mechanical efficiency, there is ascertained that both of these last-mentioned degrees of efficiency influence each other conversely. For example, an improvement in the hydraulic-mechanical behavior or property necessarily signifies a reduction in the friction losses and, inasmuch as this, in the main, can be constructively achieved only through an increase in the operationally-caused leakage gap and the tolerances of the hydrostatic machine, there is also concurrently encountered an increase in the drain oil losses and; respectively, a deterioration in the volumetric efficiency.

SUMMARY OF THE INVENTION

Accordingly, it is an object of the present invention to reduce the hydraulic losses of the hydrostatic machine pursuant to the above-mentioned type without any significant adverse influence over the volumetric losses.

The foregoing object is inventively achieved in that a pump is arranged in the drain oil line which is in a driving or operative connection with the hydrostatic machine, and which pumps off drain oil from the drain oil chamber during the operation of the hydrostatic machine, and possesses an output delivery correlated in such a manner therewith that the drain oil remaining in the drain oil chamber assumes that particular specified level in the lower region of the drain oil chamber, at which at least no splashing losses are encountered due to the rotation of the driving mechanism in the drain oil which exceed the mechanical losses of the hydrostatic machine.

These splashing losses represent the overwhelming part of the hydraulic loss constituent which depends upon the density, which is encountered due to the turbulence produced in the drain oil collected in the drain oil chamber and which can be reduced through a lowering of the drain oil in the drain oil chamber. The flows of the drain oil to the drain oil chamber remain uninfluenced therefrom, so that the volumetric losses do not increase as would in the instance of a reduction in the remaining hydraulic losses; in effect, overwhelmingly the viscous loss constituent due to the speed-proportional resistances to which the overwhelmingly laminar flows of drain oil are exposed on their path of travel towards the drain oil chamber. Through the inventive lowering of the drain oil in the drain oil chamber down to a predetermined level, which lies expediently below the driving mechanism, the overall degree of efficiency of the hydrostatic machine is considerably improved over the heretofore possible measure.

Although there is presently known, from the disclosure of U.S. Pat. No. 3,291,067, a pump in a line connected to the drain oil chamber of a swash plate-axial piston pump, and leading to the suction line thereof; this is, however, a charging pump for improving the filling of the axial-piston pump through a pressure increase at the suction or; in essence, the low-pressure side of the latter. This charging pump aspirates a portion of the drain oil from the drain oil chamber and conveys it under a rise in pressure to the low-pressure side in order to produce a pressure differential between this side and the drain oil chamber which imparts a force against the piston which is in connection with the low-pressure side in the direction facing towards the drain oil chamber, and thus maintains it in contact with the swash plate. The pressure in the drain oil chamber is hereby set to such a value above atmospheric pressure, that such a quantity of drain oil will remain in the drain oil chamber which is necessary for maintaining the lubrication of the bearing locations (as mentioned in column, lines 57 through 61), which is effected from the drain oil chamber and thus principally follows a type of different system as that of the hydrostatic machine constructed pursuant to the invention, in which the lubricating oil is obtained from the internal oil circulation between the high-pressure and low-pressure sides and then streams towards the bearing locations prior to passing into the drain oil chamber. Due to this, in principle, different type of lubrication for the bearing locations, which determines the level of drain oil in the drain oil chamber and, as a result thereof, precludes any consideration of the splashing losses as a parameter during the regulation of the drain oil level, the known axial piston pump does not belong to the relevant state-of-the-technology for the class of machines considered herein. The splashing losses of the foregoing correspond to the quantity of drain oil remaining in the drain oil chamber, which is considerable, as discussed in column 2, line 61, and is maintained at the required level through the actuation of a bypass valve and; upon occasion, through the positioning of a drain oil connection at approximately half the height of the pump housing, or through the use of a throttle valve in the internal space of the axial piston pump, which throttles the flow of drain oil to the charging pump when the level of the drain oil sinks below a predetermined value, as discussed in column 3, lines 36 through 43.

In accordance with a further modification of the invention, the output of the pump is correlated with a splashing loss-characteristics curve which extends in dependence upon the speed of rotation and; on occasion, upon the displacement volume of the hydrostatic machine. In this case, the pump can be so designed or actuated with respect to its output, that in order to avoid the splashing losses, its sets a currently required or a lower drain oil level; in essence, at an increasing speed of rotation and thereby growing splashing losses of the hydrostatic machine, the level of the drain oil will sink with consideration given to the splashing loss-characteristics curve. However, the pump can also possess an essentially constant delivery output which is correlated in such a manner with the splashing loss-characteristics curve that for an avoidance of the splashing losses at maximum speed of rotation of the hydrostatic machine, the necessary drain oil level in the drain oil chamber is also essentially maintained at lower rotational speeds or, respectively, over the entire range of rotational speeds.

The pump is expediently so constructed or, in essence, controlled such that it will pump off the drain oil down to a predetermined level commencing from that speed of rotation at which the splashing losses are equal to the mechanical losses of the hydrostatic machine. This rotational speed; for example, can be equal to approximately one-half the maximum permissible rotation speed of the hydrostatic machine.

Pursuant to another modification of the invention, the pump is a jet pump with a part for a working medium which is connected to a working medium source standing in connection with the hydrostatic machine.

This working medium source can be an auxiliary pump which produces a flow volume corresponding to the rotational speed of the hydrostatic machine, and resultingly drives the jet pump in such a manner that its output rises with an increasing rotational speed of the hydrostatic machine. As a working medium source there can; however, also serve a working pressure line which is connected to the hydrostatic machine, from which one part of the flow volume streams towards the jet pump and drives the latter at a constant displacement volume of the hydrostatic machine in dependence upon its rotational speed, and upon a variable displacement volume of the hydrostatic machine in dependence upon its rotational speed and the presently set displacement volumes thereof, in effect, in dependence upon the flow volume.

Advantageously, located in a working medium line leading to the working medium port of the jet pump, is a control valve possessing a closed and an open position, wherein the switch is activated by a control signal which is proportional to the rotational speed of the hydrostatic machine, in opposition to a preferably adjustable counter-pressure, in the direction towards the open position. In this manner, it is possible to actuate the jet pump at a predetermined rotational speed of the hydrostatic machine; in effect, commencing with the pumping off of drain oil from the drain oil chamber.

Pursuant to another embodiment of the invention, in the working medium line there can be arranged, instead of the previously-mentioned control valve, a continually adjustable; in effect, a throttle valve, whose throttling characteristic determines the delivery output characteristic of the jet pump and, for example, is correlated in such a manner with the splashing loss-characteristics curve of the hydrostatic machine, that the jet pump will for every suitable speed of rotation of the hydrostatic machine adjust the necessary drain oil level in the drain oil chamber in order to avoid the currently encountered splashing losses. In this manner, it is possible that with the lengthening period of operation of the hydrostatic machine the generally encountered change in the splashing loss-characteristics curve (increase in the flows of drain oil), this is compensated for by means of a suitable change in the throttling characteristic of the throttle valve; for instance, through a change in the spring-characteristics of a spring producing the counter-pressure, and in this indirect way to constantly correlate the delivery output characteristics of the jet pump, without any constructive modification thereof, with the splashing loss-characteristics curve of the hydrostatic machine.

BRIEF DESCRIPTION OF THE DRAWINGS

Reference may now be had to a detailed description of the invention on the basis of two exemplary embodiments, taken in conjunction with the accompanying drawings; in which.

DETAILED DESCRIPTION

Figure 1:
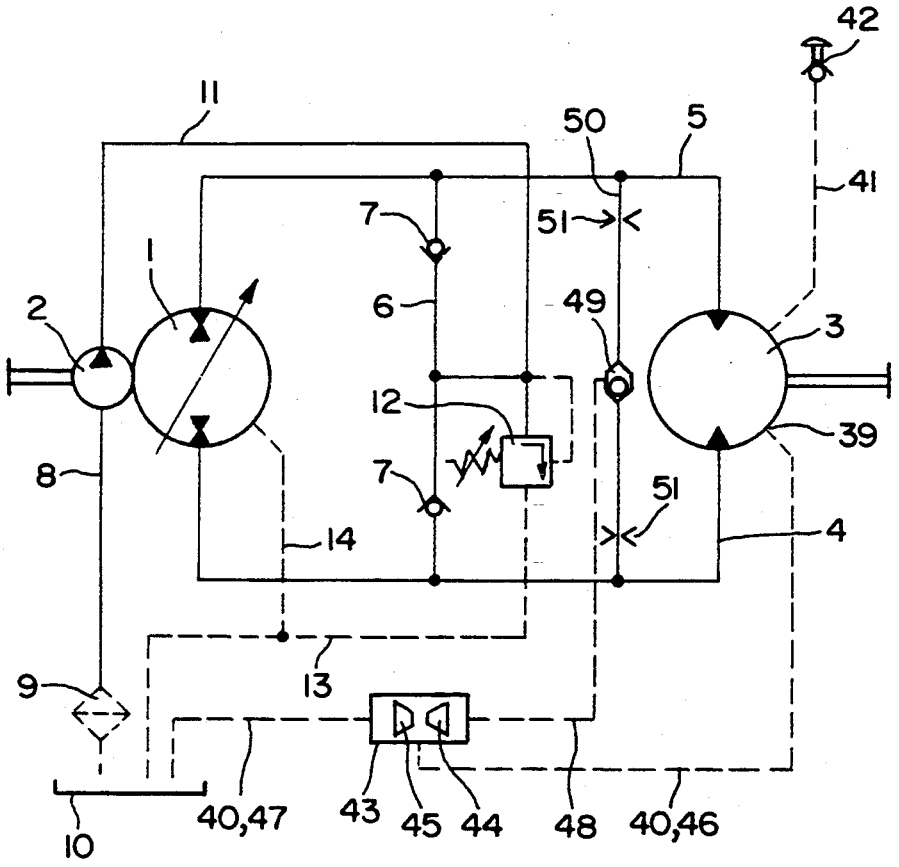
FIG. 1 illustrates a schematic circuit diagram of a hydrostatic drive which encompasses a hydromotor with drain oil discharge pursuant to a first embodiment of the invention.

The hydrostatic drive illustrated in FIG. 1 encompasses a hydraulic pump 1 which is driven by a diesel motor (not shown); for example, a hydraulic pump which is of an axial-piston construction having two delivery directions and variable pumping volumes; an auxiliary pump 2 which is mechanically connected with the hydraulic pump 1 and which; for example, is constructed as an axial-piston pump possessing one flow direction and a constant delivery volume; as well as a hydraulic motor 3 in an axial-piston construction possessing two flow directions, a constant absorption or intake volume and the inventive drain oil discharge pursuant to a first embodiment. The hydraulic motor 3; for instance, drives through the intermediary of a mechanical drive (not shown) the drive wheels (not shown) of a similarly not illustrated vehicle.

The hydraulic pump 1 and the hydraulic motor 3 are interconnected in closed circulation through two working pressure lines 4, 5. A line 6 having two non-return valves 7 interconnects both working pressure lines 4, 5. The auxiliary pump 2 is connected to a tank 10 by means of a line 8 and a filter 9. The pump 2 serves as a supply pump and is connected through a supply line 11 with the line 6, into which it connects intermediate the two non-return valves 7. Both non-return valves 7 block in the direction towards this connection. A pressure limiting valve 12 is connected to the supply line 11 for the securing of the maximum supply pressure, and leads through a relief line 13 to the tank 10. A drain oil connection or port of the hydraulic pump 1 is connected through a line 14 to the relief line 13.

Figure 4:
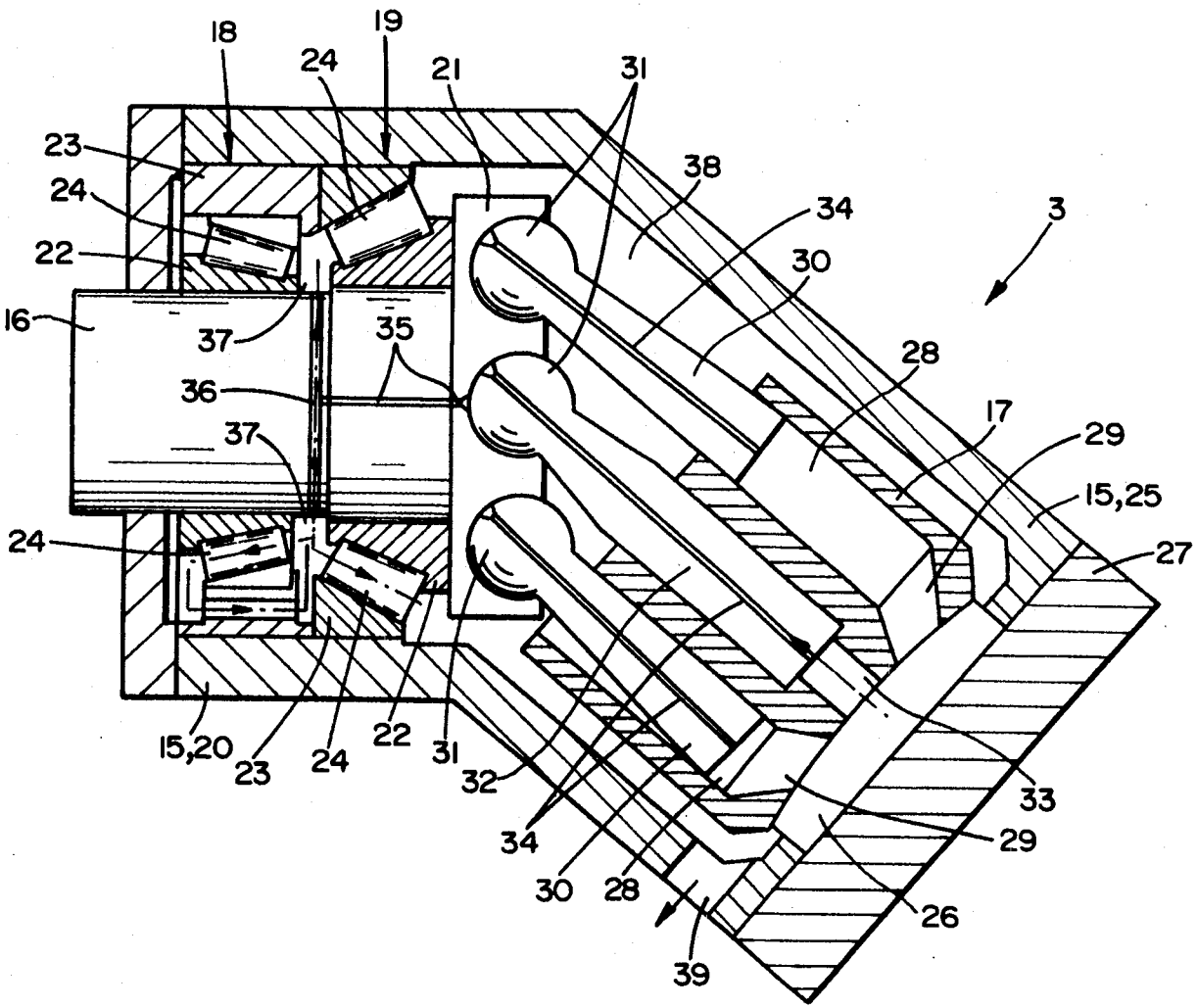
FIG. 4 PRIOR ART
FIG. 4 illustrates an axial cross-sectional view thereof the hydraulic motor of FIG. 1.

The hydraulic motor 2 is constructed as an oblique or bent-axis motor of usual construction, and is intended for horizontal installation. The motor encompasses a cylindrical housing 15 and a driving mechanism rotatably supported in the internal space of the housing; as is shown in FIG. 4.

The driving mechanism encompasses a drive shaft 16 and a cylinder block or drum 17. The drive shaft 16 is rotatably supported by means of two tapered-roller bearings 18, 19 in a horizontal housing section 20 of the housing 15, and at its free end which is located in the horizontal housing section 20, includes a flange-like section of larger diameter which represents a driving disc or swash plate 21. The driving disc 21 is located in close proximity to the tapered-roller bearing 19. Each tapered-roller bearing 18, 19, consists of an inner ring 22 which is fastened to the drive shaft 16, an outer ring 23 which is fastened to the horizontal housing section 20, and tapered rollers 24 located therebetween.

The cylinder drum 17 is rotatably supported on a control member 26 in a housing section 25 of the housing 15, wherein the housing section 25 is angled or inclined relative to the horizontal housing section 20, and wherein the control member 26 is supported against an end wall 27 of the angled housing section 25. The support for the control member 26 is self-centering; whereby for this purpose, the bearing surfaces of the cylinder drum 17 and the control member 26 are spherically constructed with, respectively, concave and convex configurations. In the control member 26 there are formed, in a known manner, two mutually facing oppositely-located control nodules (not shown) which are each connected through, respectively, a connecting member (not shown) on the hydraulic motor 3 to the working pressure lines 4, 5. In accordance with the direction of rotation of the hydraulic motor 3, either the working pressure line 4 or 5 is the advance line which is subjected to the high pressure and presently the other working pressure line 5 or 4 is the return line subjected to the low pressure.

In the cylinder drum 17 there are formed in a known manner, axially-extending cylindrical spaces 28 and which are uniformly distributed along a partial circle, which by means of cylindrical passageways 29 connect with the bearing surface of the cylinder block 17 which is supported against the control member 26; and during rotation of the cylinder drum 17 connect the last-mentioned with the connector members. In the cylindrical spaces 28 there are arranged pistons 30 which are reciprocably movable. The piston rods of the pistons are connected through ball joints 31 so as to be rotatable in conjunction with the drive disc or swash plate 21.

In a central blind bore formed in the cylinder block 17 there is seated a compression spring (not shown) which support itself against a central trunnion 32 projecting into the blind bore, and which is similarly connected by means of a ball joint 31 with the swash plate 21, and in this manner maintains the cylinder block 17, when no oil pressure forces are encountered, in contact against the control body 26. The blind bore terminates through an oil passageway 33 at the bearing surface of the cylinder block 17. This oil passageway 33 supplies through an axial through-bore 34 formed in the center trunnion 32 a further leading axial bore 35 in the swash plate 21 and drive shaft 16, and therein a circumferential groove 36 formed in a radial plane between the two tapered-roller bearings 18, 19, and radial bores 37 in the same radial plane as both tapered-roller bearings 18, 19, for the purpose of lubricating with pressurized oil from the internal oil circulation of the axial piston machine. The oil supply to the ball joints for the purpose of lubrication and maintaining the hydrostatic bearing pressure is similarly carried out from the internal oil circulation by means of the through-bore 34 in the center trunnion 32, as well as essentially similar axial through-bores in the piston 30, also identified by reference numeral 34.

The internal oil circulation encompasses the connector members, the cylindrical passageways 29 in the cylinder spaces 28 which, during the rotation of the driving mechanism 16, 17, 21, receive through the connector members which are connected to the advance line 4 or 5 the flow of drain oil standing under high pressure and which is delivered by the hydraulic pump 1, and which moves the pistons 30 from the lower dead-center point, (illustrated by the lower piston in FIG. 4) up to the upper dead-center point, (illustrated by the upper piston in FIG. 4), whereby the piston force transmits through the piston rods a torsional moment to the swash plate 21 and resultingly to the drive shaft 16. As soon as the cylinder spaces 28 come into connection with the connector members which are attached to the return line 5 or 4, the pressurized flow of drain oil flow is unstressed and flows back at low pressure (almost pressureless) to the hydraulic pump 1.

Figure 2:
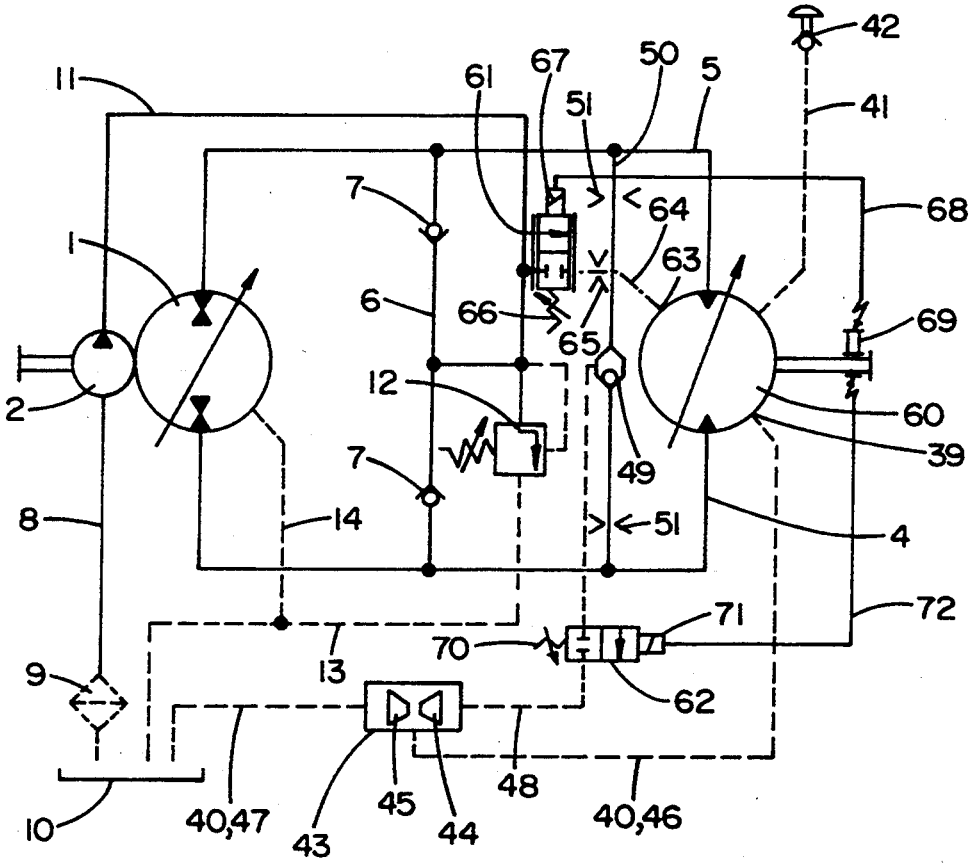
FIG. 2 illustrates a schematic circuit diagram of a hydrostatic drive which encompasses a hydraulic motor with a drain oil discharge pursuant to a second embodiment of the invention.

The portion of the internal space of the housing which is not occupied by the driving mechanism 16, 17, 21 serves as a drain oil chamber 38 which, during the operation of the hydraulic motor 3, assumes from the internal oil circulation through the operationally-required leakage gaps and tolerances discharging drain oil inclusively the lubricating oil from the mechanical and hydrostatic bearing locations 18, 19 or, respectively, 26, 31. The drain oil chamber 38 is connected through a drain oil connection 31 in the region of the lower apex point region of the inclined or angled housing section 25 proximate the end wall 27 and a further conducting drain oil line 40 (FIGS. 1 and 2) with the tank 10 (FIGS. 1 and 2). At a highest location in the installed position, the housing 1 includes a venting port (not shown), which leads through a relief line 41 up to a vent valve 42 which is actuatable in a not illustrated manner (FIGS. 1 and 2).

The inventive drain oil discharge encompasses a jet pump 43 of usual construction and possessing a housing, in which there are arranged a nozzle 44 and a diffuser 45 which is directed towards the nozzle. The housing is equipped with a working medium port which is oriented towards the nozzle 44, and a pressurized medium port which is oriented towards the diffuser 45, and a suctioning port connecting into the space intermediate the nozzle 44 and the diffuser 45. The suctioning port is connected through a first line segment 46 of the drain oil line 40 with the drain oil port 39 of the hydraulic motor 3. A further line segment 47 of the drain oil line 40 connects the pressure port of the jet pump 43 with the tank 10. A working medium line 48 leads from the working medium port of the jet pump 43 to a two-way valve 49 in a connecting line 50 which interconnects the working pressure lines 4 and 5. Both sides of the two-way valve 49 are each, respectively, provided with a throttle element 51.

The function of the hydrostatic drive is known to those skilled in the art and as a result, is only briefly discussed. As soon as the hydraulic pump 1 is actuated, it produces a pressure-charged flow volume corresponding to its speed of rotation and its currently set delivery or output volume, which is then conducted through the advance line 4 or 5 to the hydraulic motor 3, where its compressive energy is converted into mechanical energy; in effect, the hydraulic motor 3 or; in essence, its driving mechanism 16, 17, 21 and thereby also the drive wheels are set into rotation, whereby the pressure of the flow volume corresponds to the driving moment currently required by the drive wheels. The flow volume then streams almost in a pressureless condition through the return line 5 or 4 back to the hydraulic pump 1. Inasmuch as the hydraulic pump 3 possesses a constant absorption or intake volume, its speed of rotation is somewhat proportional to the flow volume which it receives and which is produced by the hydraulic pump 1.

During the rotation of the driving mechanism 16, 17, 21, there egresses from the internal oil circulation of the hydraulic motor 3 drain oil, inclusive lubricating oil discharging from the hydrostatic bearing locations; in effect, the ball joints 31 and the control member 26, as well as from the mechanical bearing locations; in effect, from the tapered-roller bearings 18, 19, and collects itself in the drain oil chamber 38.

Figure 3:
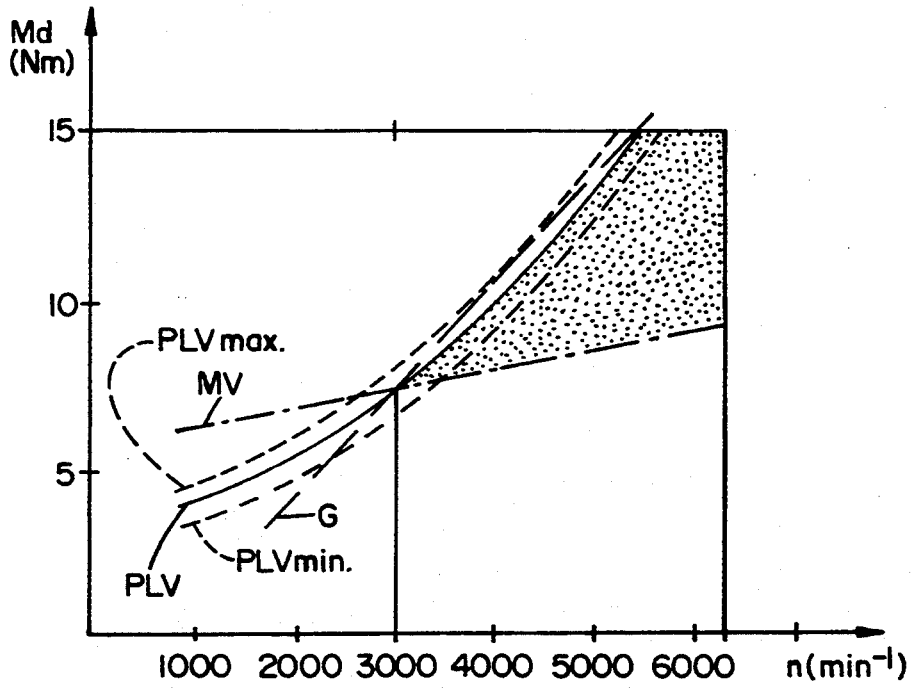
FIG. 3 illustrates a graphical plot which represents the rotational loss moments of the hydraulic motor as illustrated in FIGS. 1 and 2 encountered during operation, in dependence upon its rotational speed or, respectively, its rotational speed and suction volume.

During the rotation of the hydraulic motor 3, besides the mechanical losses there are also encountered hydraulic losses, which rise with an increasing rotational speed, and contain a loss constituent which is overwhelmingly dependent upon the density of the pressurized oil, the so-called splashing loss constituent which is caused by the rotation of the driving mechanism 16, 17, 21 in the drain oil present within the drain oil chamber 38 and thereby encountered turbulence formation, and which is represented in FIG. 3 by the solidly drawn splash loss-characteristics curve PLV. FIG. 3, furthermore, shows through the phantom line MVd the dependence of the mechanical losses. There can be recognized that in the lower rotational speed range up to the critical rotational speed of 3,000 rpm (approximately one-half the maximum permissible rotational speed of 6300 rpm), the splash loss constituent is lower and in the upper rotational speed range above 3,000 rpm is greater than the mechanical losses.

A portion of the flow volume which is generated by the hydraulic pump 1 and received by the hydromotor 3 is conveyed from the advance line 4 or 5 through the applicable section of the connecting line 50 possessing therewith associated throttle element 51, the two-way valve 49, the working medium line 48 and the pressurized medium port of the jet pump 43 towards the nozzle 44 thereof, from which it exits at a high rate of speed and produces a vacuum at the suction port which, as soon as it is adequate for overcoming the flow resistances encountered in the path of travel between the hydraulic motor 3 and tank 10 and, upon occasion, the height of the pressure in the tank 10 above that in the hydraulic motor 3, suctioning drain oil from the drain oil chamber 38 of the hydraulic motor 3 through its drain oil port 39 and the first line segment 46 of the drain oil line 40. In the diffuser 45, the velocity energy of the suctioned drain oil is converted into pressure energy, which causes a conveyance of drain oil through the pressure port and the second line segment 47 of the drain oil line 40 to the tank 10. Hereby, the jet pump 43 is so designed with respect to its delivery output such that, at somewhat a flow volume corresponding to the critical rotational speed of 3,000 rpm, it commences with the suctioning of drain oil from the drain oil chamber 38, and at an increasing rotational speed, lowers the level of drain oil in the drain oil chamber 38 in conformance with the splashing loss-characteristics curve PLV or, respectively, a linear G approximately the foregoing (FIG. 3), such that no splashing losses are encountered which are higher than the mechanical losses of the hydraulic motor 3. This is valid for the entire rotational speed range of from 3,000 rpm up to the maximum speed of rotation, at which the level of drain oil lies below the cylinder block 17; inasmuch as with an increase in the rotational-speed proportional flow volume, which is generated by hydraulic pump 1 and received by the hydraulic motor 3, the delivery output of the jet pump 43 which is driven by this flow volume is increasing somewhat at the same extent as that of the essentially rotational-speed proportional splashing losses or, in essence, the linear G. In this manner, there are avoided the entire splashing losses which are represented in FIG. 3 through the black-shaded region between the lines PLV or, respectively, G and MV at the right of the intersection of these two lines.

The pressurized medium port of the jet pump pursuant to FIG. 1, in an alternative embodiment, can be connected to an auxiliary pump, which is coupled to the hydraulic motor and which produces a flow volume corresponding with the speed of rotation thereof. Also in this instance does the output of the jet pump depend upon the speed of rotation of the hydraulic motor, even when the latter is a regulating motor which is settable to different intake volumes. The same dependence of the delivery output of the jet pump on the rotational speed of the hydraulic motor is attained when the hydraulic motor and the hydraulic pump possess a constant displacement volume, and the auxiliary pump which is coupled to the hydraulic pump serves as a working medium source for the jet pump.

Furthermore, there is also present the capability of suctioning drain oil from the drain oil chamber, as well as from the hydraulic motor as well as from the hydraulic pump down to the predetermined level. In this instance, the two hydrostatic machines can each have their own jet pump or, alternatively, a common jet pump associated therewith which is arranged in a collecting line for drain oil leading to the tank, and into which there connect the drain oil lines of both of these hydrostatic machines. Also in this instance, either the working pressure line or an auxiliary pump which is coupled to the hydrostatic machine and which generates a flow volume which corresponds to the rotational speed thereof, can be employed as a working medium source for the jet pump, whereby at least one of the two hydrostatic machines possesses a constant or a variable displacement volume.

The hydrostatic drive pursuant to FIG. 2 utilizes instead of the hydraulic motor 3, at an otherwise identical construction and function as that disclosed in FIG. 1, a hydraulic motor 60 with a variable intake volume in a known and thereby not in more detail discussed manner, as well as a continually adjustable; in effect, throttling and switching 2/2-way valve 61 or, respectively, 62.

The housing of the hydraulic motor 60 possesses a flushing oil port 63; which is connected by means of a passageway system (not shown) with mechanical bearing locations of the hydraulic motor for the purpose of supplying the latter with lubricating oil.

The continually adjustable 2/2-way valve 61 is arranged in a flushing oil line 64 having a throttle 65, and which connects a supply line 11 with the flushing oil port 63 of the hydraulic motor 60. Through the force of an adjustable spring 66 it is maintained in the closing position illustrated in FIG. 2, in which the two ports leading to the flushing oil line 64 are blocked, and displaceable through a proportional magnet 67 against the force of the spring 66 in the direction towards an end position in which the two ports to the flushing oil line 64 are completely open. The proportional magnet 67 is connected through a signal line 68 to a rotational speed sensor 69, which is arranged on the drive shaft of the hydraulic motor 60. The spring characteristics of the spring 66 and/or the magnetic force-lift characteristics of the proportional magnet 67 are selected such that the continually adjustable 2-way valve 61 is displaced in a direction towards the end position at an increasing rotational speed of the hydraulic motor 60 and the thereby increasing requirement for lubricating oil; in effect, is opened, whereby there is ensured a supply of lubricating oil over the entire rotational speed range. The 2/2-way valve in the flushing oil lines 64 can also be constructed as a switching valve which is analogous to the 2-way valve 62, and upon reaching of a critical rotational speed of the hydraulic motor causing the beginning of a lacking lubricating oil supply for the mechanical bearing positions, the valve is switched into the opened position.

The switching 2/2-way valve 62 is arranged in the working medium line 48. It is maintained by means of the biasing force of an adjustable spring 70 in the closed position as illustrated in FIG. 2, in which the two ports to the working medium line 48 are blocked; it is transferred into an open position through an electric magnet 71 against the biasing force of spring 70, in which the two ports are opened to the working medium line 48. The electromagnet 71 is connected through a signal line 72 to the rotational speed sensor 69. The biasing force of the spring 70 and/or the magnetic force of the electromagnet 71 are selected such that the switching 2-way valve 62 is transferred at the critical rotational speed of 3,000 rpm from the closed position into the opened position and, in this manner, the jet pump is actuated so as to now, in the same manner as the jet pump pursuant to FIG. 1, suction drain oil from the hydraulic motor 60 to the extent that there will not be encountered any splashing losses exceeding the mechanical losses. The valve in the working medium line 48 can also be constructed as a continually adjustable valve analogous to the 2/2-way valve 61 and at an increasing rotational speed of the hydraulic motor 60, can be so displaced in a direction towards the end position, in effect, being opened, whereby the jet pump will adjust the level of the drain oil in the drain oil chamber which is necessary for avoiding the respective splashing losses. In other words, this continually adjustable multi-way valve determines the applicable delivery output of the jet pump 43; consequently, it is also possible to employ a jet pump possessing a constant delivery output.

Inasmuch as the jet pump 43 is driven through the flow volume which is received from the hydraulic motor 60, and the hydraulic motor 60 is adjustable to different intake volumes, its delivery output increases with a rising rotational speed and increasing intake volume, so that the level of drain oil sinks in conformance with the splashing loss-characteristics curve corresponding to the currently set intake volume; for example, at a low intake volume pursuant to the splashing low-characteristics curve $PLV_{min}$ illustrated by the phantom-line in FIG. 3, and at a large intake volume pursuant to the splashing loss-characteristics curve lines $PLV_{max}$ which is also illustrated by a phantom-line in FIG. 3, or at a linear (not shown) which approximately represents one of the applicable splashing loss characteristics-curves.

What is claimed is:

1. A hydrostatic machine comprising a housing; a driving mechanism rotatably supported within said housing; a portion of the space within said housing which is a portion unoccupied by the driving mechanism constituting a drain oil chamber for taking up drain oil inclusive lubricating oil discharged from bearing locations of the hydrostatic machines; said chamber being connected to a tank through at least one drainage oil port in the housing and a drain oil line leading to said tank; a pump located in said drain oil line in operative connection with the hydrostatic machine which, during operation of the hydrostatic machine, pumps off oil from the drain oil chamber and possesses an output correlated with said machine such that drain oil remaining in the drain oil chamber in a lower region of said drain oil chamber assumes a predetermined level at which at least no splashing losses exceeding any mechanical losses of the hydrostatic machine are encountered resulting from rotation of the driving mechanism in the drain oil, and means correlating the output of the pump with a splashing loss-characteristics curve PLV extending in dependence upon the speed of rotation of the hydrostatic machine.

2. A hydrostatic machine comprising a housing; a driving mechanism rotatably supported within said housing; a portion of the space within said housing which is a portion unoccupied by the driving mechanism constituting a drain oil chamber for taking up drain oil inclusive lubricating oil discharged from bearing locations of the hydrostatic machine; said chamber being connected to a tank through at least one drainage oil port in the housing and a drain oil line leading to said tank; a pump located in said drain oil line in operative connection with the hydrostatic machine which, during operation of the hydrostatic machine, pumps off oil from the drain oil chamber and possesses an output correlated with said machine such that drain oil remaining in the drain oil chamber in a lower region of said drain oil chamber assumes a predetermined level at which at least no splashing losses exceeding any mechanical losses of the hydrostatic machine are encountered resulting from rotation of the driving mechanism in the drain oil; and means correlating the output of the pump with a splashing loss-characteristics curve $PLV_{min}$; $PLV_{max}$ extending in dependence upon the speed of rotation and the displacement volume of the hydrostatic machine.

3. A hydrostatic machine as claimed in claim 1 or 2, wherein said pump pumps off the drain oil down to said predetermined level of drain oil commencing with the rotational speed of the machine at which the splashing losses are equal to the mechanical losses of the hydrostatic machine.

4. A hydrostatic machine as claimed in claim 1 or 2, wherein said predetermined level of drain oil is located below said driving mechanism.

5. A hydrostatic machine as claimed in claim 1 or 2, wherein said pump comprises a jet pump including a port for the inlet of a working medium, and a source for said working medium in communication with said hydrostatic machine is connected with said port.

6. A hydrostatic machine as claimed in claim 5, wherein said source for said working medium comprises an auxiliary pump driving said jet pump and generating a flow volume of said working medium in correspondence with the speed of rotation of said hydrostatic machine.

7. A hydrostatic machine as claimed in claim 5, wherein said source for said working medium comprises a pressurized working line connected to said hydrostatic machine.

8. A hydrostatic machine as claimed in claim 5, wherein a control valve having a closed and an open position is arranged in a working medium line leading to a working medium port of said jet pump; and means for generating a control signal which is proportional to the speed of rotation of the hydrostatic machine so as to actuate said control valve into a direction towards the open position opposite means exerting a counter-pressure on said valve towards the closed position.

9. A hydrostatic machine as claimed in claim 5, wherein a valve which is continually adjustable between a closed position and an open position is arranged in a working medium line leading to the working medium inlet port of said jet pump; and means for generating a control signal which is proportional to the speed of rotation of the hydrostatic machine so as to actuate said valve into a direction towards the open position opposite means exerting a counter-pressure on said valve towards the closed position.

10. A hydrostatic machine as claimed in claim 1 or 2, wherein a flushing oil connection leads through a passageway system to mechanical bearing locations for supplying said locations with lubricating oil prior to said oil being discharged to said drain oil chamber; a control valve having an open and a closed position which is arranged in a flushing oil line leading to the flushing oil connection; and means for generating a control which is proportional to the speed of rotation of the machine so as to actuate said valve into a direction towards the open position opposite means exerting a counter-pressure on said valve towards the closed position.

11. A hydrostatic machine as claimed in claim 1 or 2, wherein a flushing oil connecting leads through a passageway system to mechanical bearing locations for supplying said locations with lubricating oil prior to said oil being discharged to said drain oil chamber; a valve continually adjustable between a closed and an open position being arranged in a flushing oil line leading to said flushing oil connection; means for generating a control signal which is proportional to the speed of rotation of the hydrostatic machine so as to actuate said valve into a direction towards the open position opposite means exerting a counter-pressure on said valve towards the closed position.

12. A hydrostatic machine as claimed in claim 1 or 2, comprising a venting arrangement.

13. A hydrostatic machine as claimed in claim 1 or 2, wherein the drain oil port in the installed condition of the hydrostatic machine is arranged in the region of a lower apex point of the housing.

14. A hydrostatic machine as claimed in claim 1 or 2, wherein at least one working pressure line connects said machine with at least one further hydrostatic machine so as to commonly form a hydrostatic drive; a jet pump having a working medium port being located in the drain oil line of the hydrostatic machine, said port being connected to an auxiliary pump which drives said jet pump and generating a flow volume of said working medium in correspondence with the speed of rotation of the further hydrostatic machine, said at least the further hydrostatic machine possessing a constant displacement volume.

15. A hydrostatic machine as claimed in claim 1 or 2, wherein at least one working pressure line connects said machine with a further hydrostatic machine so as to commonly form a hydrostatic drive, the drain oil lines of said two hydrostatic machines connecting into-a common drain oil collecting line leading to a tank, a jet pump having a working medium port being arranged in said line, said port being connected to a source for said working medium which is in communication with at least one of said hydrostatic machines.

16. A hydrostatic machine as claimed in claim 15, wherein the source for said working medium comprises an auxiliary pump which drives said jet pump and produces a flow volume of said working medium in correspondence with the speed of rotation of one of said hydrostatic machines, and at least one of said hydrostatic machines possesses a constant displacement volume.

17. A hydrostatic machine as claimed in claim 15, wherein said source for the working medium source comprises a working pressure line and at least one of said hydrostatic machines possesses a constant displacement volume.

18. A hydrostatic machine as claimed in claim 15, wherein said source for the working medium comprises an auxiliary pump which drives said jet pump and produces a flow volume of said working medium in correspondence with the speed of rotation of one of said hydrostatic machines, and at least one of said hydrostatic machines possesses a variable displacement volume.

19. A hydrostatic machine as claimed in claim 15, wherein said source for the working medium comprises a working pressure line and at least one of said hydrostatic machines possesses a variable displacement volume.

* * * * *